US008800168B1

(12) United States Patent
Propét

(10) Patent No.: US 8,800,168 B1
(45) Date of Patent: Aug. 12, 2014

(54) CUSTOMIZABLE INSOLE

(76) Inventor: Robert Propét, Auburn, WA (US)

( * ) Notice: Subject to any disclaimer, the term of this patent is extended or adjusted under 35 U.S.C. 154(b) by 289 days.

(21) Appl. No.: 13/161,444

(22) Filed: Jun. 15, 2011

(51) Int. Cl.
*A43B 7/22* (2006.01)
*A43B 7/14* (2006.01)
*A43B 17/02* (2006.01)

(52) U.S. Cl.
CPC . *A43B 7/22* (2013.01); *A43B 7/144* (2013.01); *A43B 17/02* (2013.01); *A43B 7/142* (2013.01)
USPC ..... 36/44; 36/173; 36/92

(58) Field of Classification Search
CPC ..... A43B 7/142; A43B 7/143; A43B 7/144; A43B 7/16; A43B 7/22; A43B 7/1495; A43B 13/00; A43B 13/16; A43B 13/18; A43B 13/12
USPC ..... 36/43, 44, 71, 88, 145, 160, 161, 36/91–93, 107, 173
See application file for complete search history.

(56) References Cited

U.S. PATENT DOCUMENTS

| | | | | |
|---|---|---|---|---|
| 1,272,994 | A | 7/1918 | Phelps | |
| 4,813,157 | A | 3/1989 | Boisvert et al. | |
| 5,138,774 | A | 8/1992 | Sarkozi | |
| 5,669,162 | A | 9/1997 | Dyer | |
| 5,733,647 | A * | 3/1998 | Moore et al. | 428/304.4 |
| 6,000,147 | A | 12/1999 | Kellerman | |
| 6,216,365 | B1 * | 4/2001 | Cohen | 36/44 |
| 6,282,816 | B1 * | 9/2001 | Rosendahl | 36/44 |
| 6,939,502 | B2 * | 9/2005 | Lyden | 264/496 |
| 7,665,169 | B2 * | 2/2010 | Cheskin et al. | 12/146 B |
| 7,908,768 | B2 * | 3/2011 | Cheskin et al. | 36/44 |
| 2003/0005599 | A1 * | 1/2003 | Panaccione | 36/43 |
| 2004/0194344 | A1 * | 10/2004 | Tadin | 36/44 |
| 2005/0166425 | A1 * | 8/2005 | Seiter | 36/44 |
| 2006/0107552 | A1 * | 5/2006 | Clark et al. | 36/97 |
| 2006/0123664 | A1 * | 6/2006 | Boyd et al. | 36/44 |
| 2008/0010857 | A1 * | 1/2008 | Green | 36/44 |
| 2009/0049712 | A1 | 2/2009 | Steszyn et al. | |
| 2009/0172972 | A1 | 7/2009 | Rosen | |
| 2010/0064550 | A1 | 3/2010 | Kahn et al. | |

FOREIGN PATENT DOCUMENTS

| | | |
|---|---|---|
| DE | 20011334 | 12/2000 |
| EP | 0173396 | 3/1986 |
| WO | 0072714 | 12/2000 |
| WO | 2006133382 | 12/2006 |
| WO | 2007141797 | 12/2007 |
| WO | 2010030186 | 3/2010 |

* cited by examiner

*Primary Examiner* — Jila M Mohandesi
(74) *Attorney, Agent, or Firm* — Patrick J. S. Inouye; Krista A. Wittman

(57) ABSTRACT

A customizable insole is provided. A base layer having a substantially flat surface shaped to a sole of a foot extends from a heel of the foot to a ball of the foot. One or more support pads each having a different contoured shape of varying height is removably affixed on a top surface of the base layer. An upper layer having a substantially flat surface shaped to the sole of the foot is affixed on top of the support pads and base layer.

14 Claims, 7 Drawing Sheets

CUSTOMIZABLE INSOLE

FIELD

This application relates in general to insoles for shoes and, in particular, to a customizable insole.

BACKGROUND

Shoes protect a wearer's feet from hot, cold, bumpy, or sharp surfaces, as well as provide comfort and support. Each shoe generally includes, inter alia, an upper, insole, and outsole. The upper secures the shoe onto a wearer's foot, while the outsole is located below the upper and has direct contact with the ground. A midsole can optionally be positioned on top of the outsole to provide shock absorbance. The insole is the interior bottom of a shoe that sits directly beneath the user's foot, and on top of the outsole or optional midsole. Insoles are commonly used to provide cushioning and support to maximize comfort and relieve pain.

Available insoles can be manufactured to address many factors, including shoe size, medical ailments, such as plantar fasciitis, and target comfort areas. Conventional insoles generally include a flat piece of material shaped to a sole of a foot, which can be adjusted to a wearer's foot by cutting the insole with scissors. Another common type of insole is shaped and sized to fit within the shoe of an average wearer based on a designated size. However, both types of insoles, fails to allow adjustments and the wearer must purchase a new pair of insoles each time discomfort is experienced, such as when the user's pain changes or a different injury occurs.

Currently, there are different types of adjustable insoles available, such as the arch support described in U.S. Pat. No. 1,272,994, to Phelps. The support includes sewn pockets in multiple locations, including under the instep, at the front of the instep, and at each side of the heel to receive pads for foot support. Thus, the placement of the pads are limited by the location and depth of the pockets, which may not be sufficient to relieve the wearer's discomfort.

A lining element is described in U.S. Pat. No. 5,138,774, to Sarkozi, as having openings formed between a top and a bottom layer. Access to the openings is provided through the bottom layers to enable insertion of pads to fit within cavities formed by the openings. The openings are elastic to prevent the pads from slipping out of the cavities. However, the openings limit placement of the pads and may not be sufficient to relieve the wearer's discomfort.

The insole described in U.S. Patent Application Publication No. 2009/0172972, to Rosen, includes a foothold and an abutment that is mounted beneath the foothold. A chamber is located within the foothold for placement of the abutment, which includes pins on a top surface for interconnecting with conforming recesses located on a bottom surface of the foothold. Further, an optional arcuate metatarsal support can be located at a lower part of the foothold. Yet, the designated recesses positioned on the foothold limit the placement of the abutment and may not satisfy a wearer's needs.

A further insole, as described in U.S. Patent Application Publication No. 2010/0064550, to Kahn et al., includes a top layer, bottom layer, and a pocket between the top and bottom layers for placement of one or more inserts. The pocket is positioned to correspond with the arch of a wearer's foot. Thus, a user is limited to making arch adjustments on the insole based on the location of the pocket.

A still further insole, as described in U.S. Pat. No. 4,813,157, to Boisvert et al., includes a top layer and a bottom layer that are interconnected via a pressure adhesive. The top layer includes score lines to allow tearing of the scored areas from the insole. Further, pad layers can be affixed to the bottom layer. A first pad layer has dimensions identical to a top portion of the top layer, while second, third, fourth, and fifth pad layers have progressively decreasing dimensions and are positioned to align with a wearer's arch. However, the insole fails to include a cover layer over the pad layers to prevent moving or slipping of the pad layers during use of the insole. Additionally, the pad layers are only configured for adjustment of an arch support in the insole.

Accordingly, there remains a need for an insole that is completely and easily customizable by a user, as well as reusable for different customization, if needed. Preferably, the insole includes a cover for preventing movement of support pads used in customization of the insole.

SUMMARY

A customizable shoe insole system includes a base layer, support pads, and an upper layer. The base layer has a substantially flat surface shaped to a sole of a foot and extends from a heel of the foot to a ball of the foot. One or more support pads each having a different contoured shape of varying height is removably affixed on a top surface of the base layer. The upper layer has a substantially flat surface shaped to the sole of the foot and is affixed on top of the support pads and base layer.

Still other embodiments of the present invention will become readily apparent to those skilled in the art from the following detailed description, wherein are described embodiments by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Insoles, when used with shoes, provide comfort and support for the feet of a user. Specifically, conventional insoles provide designated areas on an insole for adjusting comfort; however, users may find that support is required in an area different from the designated area. Thus, the conventional insoles fail to offer a user a customizable and reusable product for use over extended periods of time, while also providing a desired amount of comfort and pain relief, if necessary. A user customizable insole allows the user to position and adjust one or more support pads for obtaining the desired comfort without restriction pad placement.

Figure 1:
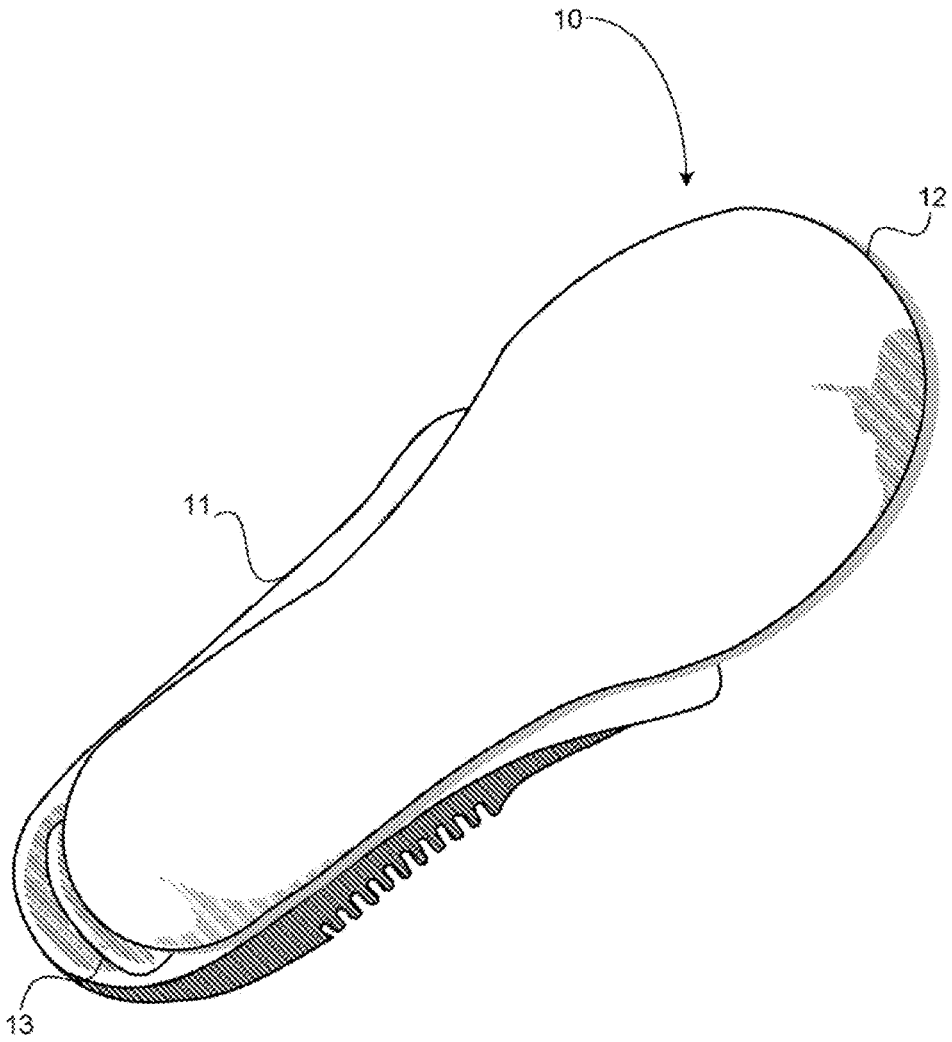
FIG. 1 is a perspective view of a customizable insole, in accordance with one embodiment.

The customizable insole is adjustable to allow a user to maximize the fit and comfort of the insole. FIG. 1 is a perspective view of a customizable insole 10, in accordance with one embodiment. The customizable insole 10 includes an upper layer 12, a base layer 11, and one or more adjustable support pads 13 of varying size and firmness. The base layer 11 can be shaped to correspond with a portion of the sole of a user's foot. A length of the base layer 11 can be dependent on foot size and extends from the user's heel towards the ball of the foot. Specifically, the base layer can extend prior to, midway, or beyond the ball of the foot. A height of the base layer can be dependent on a type of material used. However, in one embodiment, a minimum and maximum height can be assigned to ensure that the customizable insole fits comfortably within a shoe and allows adequate room for the user's foot. The base layer is further described below with reference to FIGS. 3 and 5.

The upper layer 12 is shaped to correspond to the sole of the user's foot and can be removably affixed on a top surface of the base layer 11. The length of the upper layer is variable and can be selected based on a shoe size and width of the user's foot. The upper layer can be made from material, including foam, rubber, gel, cellulosic paper board, or synthetic non woven insole board. Other materials are possible. A height of the upper layer can be dependent on a type of material used, a height of the base layer, and the shoe in which the customizable insole is to be used. However, in one embodiment, a minimum and maximum height can be assigned to ensure that the insole fits comfortably within a shoe and allows adequate room for the user's foot. A top surface of the upper layer is substantially flat and can be covered by a material, such as felt, mesh, or other material to absorb moisture released from the user's foot. When affixed, the upper layer sits within the raised sidewalls of the base layer and the upper layer toe segment extends above and over the ball segment of the base layer.

One or more pads 13 can be positioned between the upper 12 and base 11 layers for customization of the insole to a desired configuration for comfort. The pads can be placed by the user. Once placed, the user can test the customizable insole. If determined to be uncomfortable, the user can then remove and replace the pads in a different configuration until maximum comfort is achieved.

Figure 2:
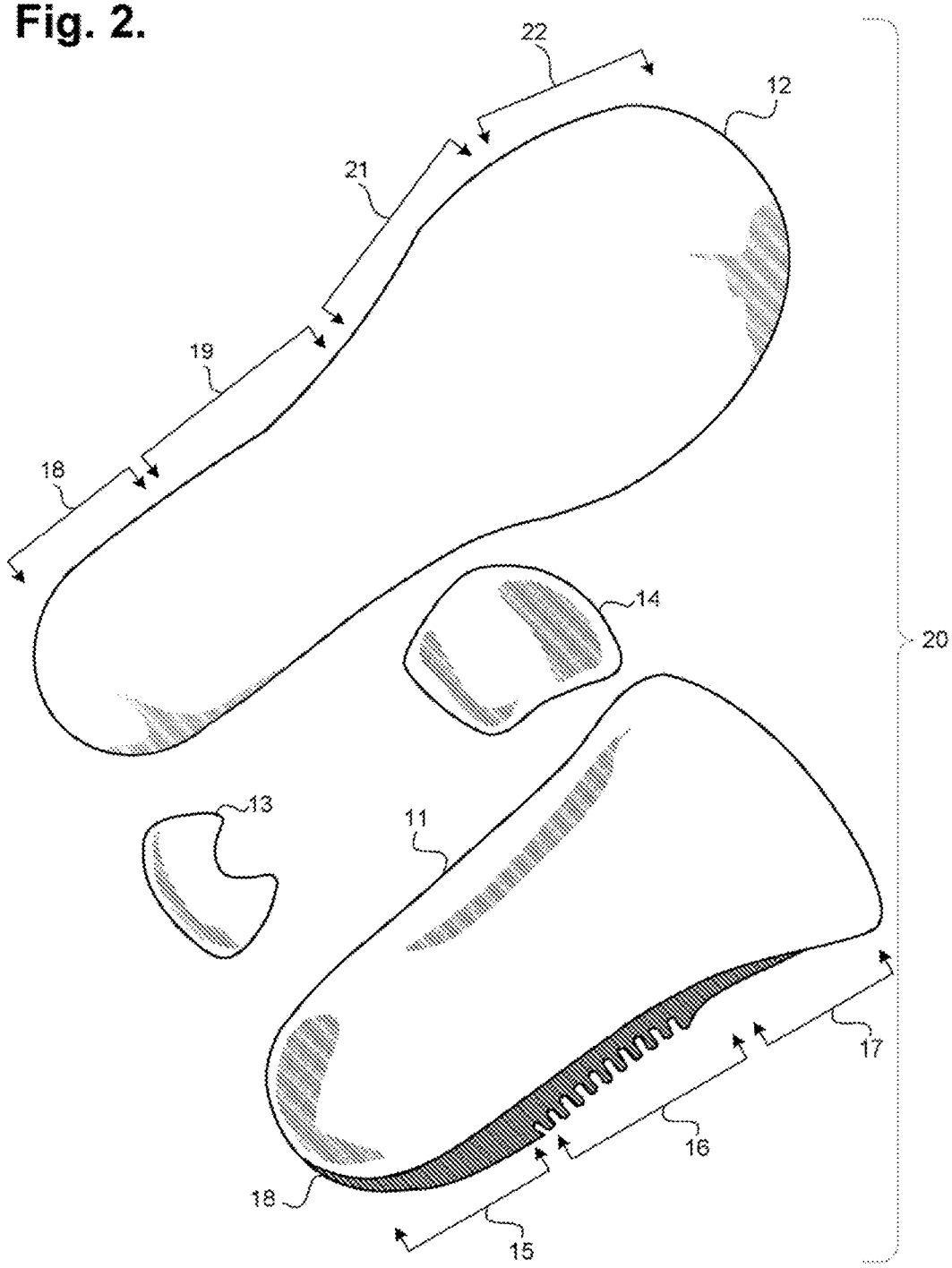
FIG. 2 is an exploded perspective view showing, by way of example, the customizable insole of FIG. 1 with support pads.

Together, the base layer, support pads, and upper layer provide a reusable and reconfigurable insole that can be manipulated by the user. FIG. 2 is an exploded perspective view 20 showing, by way of example, the customizable insole of FIG. 1 with support pads. A base layer 11 forms the bottom of the customizable insole system and sits on a top surface of an outsole or midsole of a shoe worn by the user. The base layer can be shaped to a portion of a sole of the user's foot and can include a heel segment 15, arch segment 16, and ball segment 17. One end of the heel segment 15 forms a proximal end of the customizable insole, while the other end is affixed to a proximal end of the arch segment 16. A distal end of the arch segment is affixed to a proximal end of the ball segment 17, which extends to form a distal end of the base layer, which has a substantially straight edge with rounded corners.

The heel segment 15 is shaped to the heel of the user. A raised sidewall 18 extends upward from a top surface of the heel segment 15 and surrounds an outer edge of the heel segment 15 on the proximal end. The raised sidewall 18 can extend along the outer edge of the arch segment and taper toward the ball segment 17. The base layer 11 can include one or more openings formed to provide comfort and allow placement of support pads, if needed.

A length of the base layer 11 can extend from the user's heel to a position that corresponds to the ball of the user's foot. Specifically, the base layer can extend to just prior to, midway, or beyond the ball of the foot. The base layer 11 can be made from materials, including thermal rubber, plastic, or cork. Other materials and segments are possible. The base layer 11 can be pre-manufactured based on shoe size and foot width, or customized to each individual user. An attachment material can cover a top surface of the base layer to removably receive support pads and the upper layer. The attachment material can include hook and loop material or adhesive, as well as other attachment materials. Additionally, an attachment material can cover a bottom surface of the base layer to affix the customizable insole to an outsole or midsole of a shoe to prevent movement of the insole within the shoe.

Figure 3:
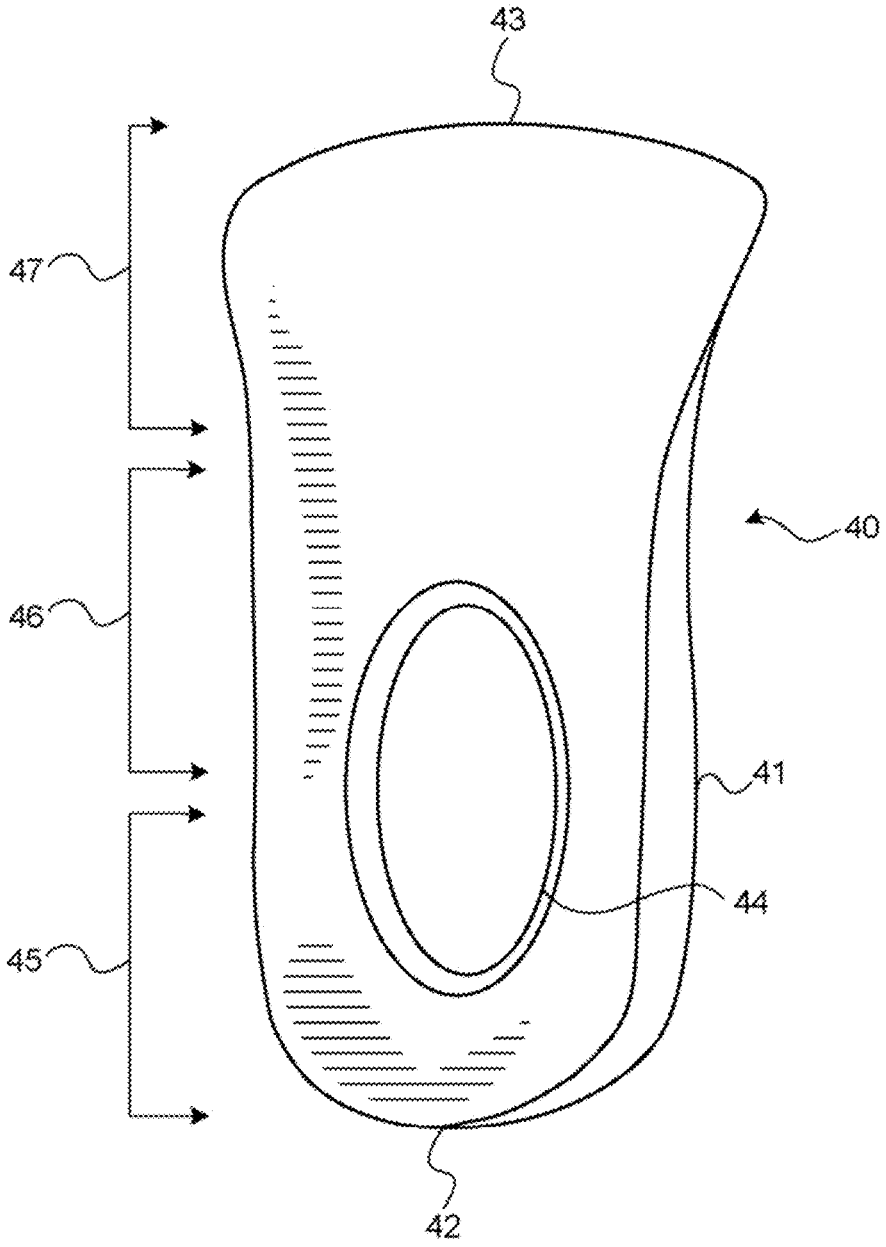
FIG. 3 is a top view of a full heel base layer for use with the customizable insole of FIG. 1.

Different shaped base layers are possible to allow the user further options for customizing the insole to a desired fit. FIG. 3 is a front view of a filled base layer 40 for use with the customizable insole of FIG. 1. The filled base layer 40 can include a heel segment 45, arch segment 46, and a ball segment 47. A width of the split base layer 40 can be greatest on a distal end of the ball segment 47 and then, slightly narrow through the arch segment 46, towards the heel segment 45. The heel segment 45 can be a substantially flat surface within which a heel opening 44 can be optionally formed to provide support. If desired by a user, the opening 44 can be filled with one or more support pads. In a further embodiment, other openings can be formed within the filled base layer 40. A proximal end of the heel segment can be rounded to conform to the shape of a user's heel, while the other end is interconnected to the arch segment. An outer edge of the heel segment can be surrounded by a raised sidewall 41 that surrounds the heel segment 45 and arch segment 46, and tapers at the toe segment 47. The raised sidewall assists in positioning the user's foot, particularly, the heel and arch, to prevent movement within a shoe.

The arch segment 46 can include a substantially flat surface with a raised arch support (not shown) positioned on an inner side of the base layer that corresponds to the user's arch. The arch support can include a contoured surface that is shaped to a user's arch. A bottom surface of the arch support can be filled until the bottom surface is equal with the bottom surface of the base layer. Alternatively, the bottom of the arch support can be unfilled so that a bottom surface of the arch support is raised in comparison with the bottom surface of the base layer.

Figure 4:
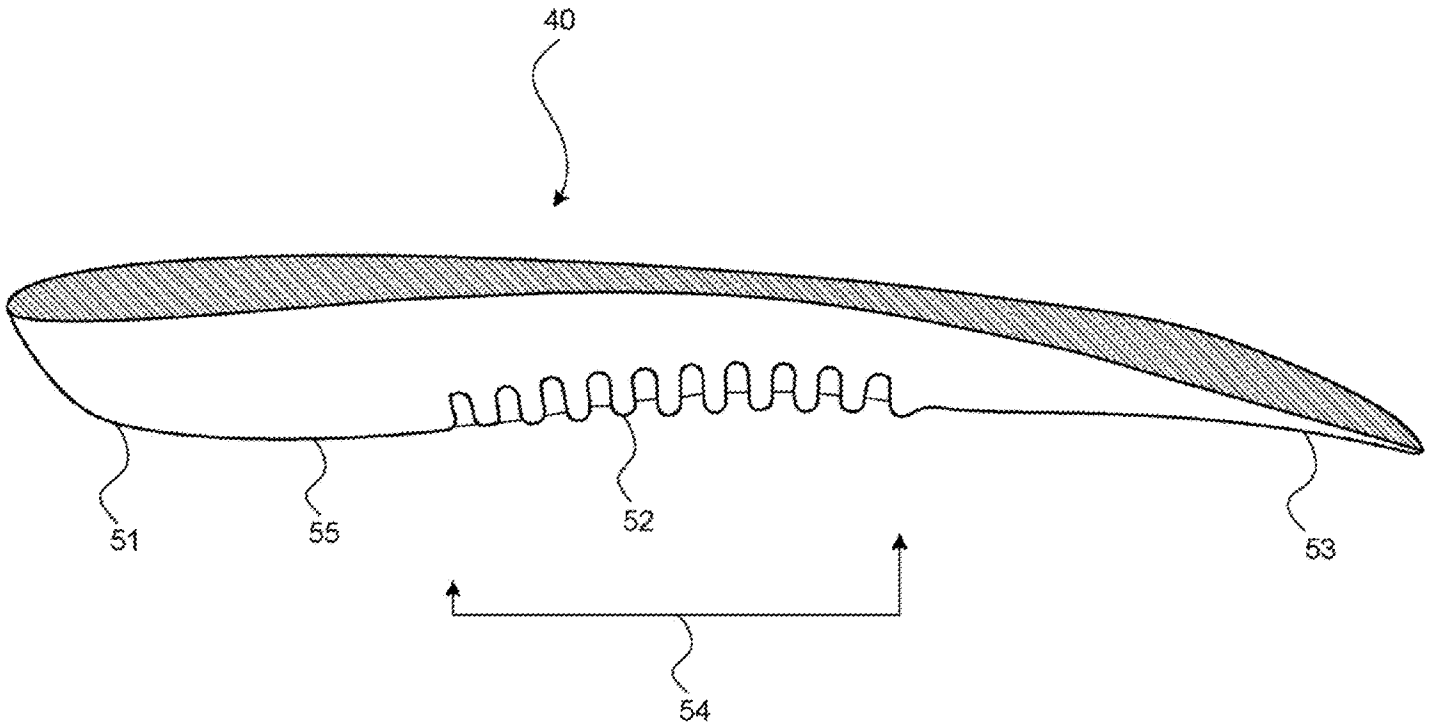
FIG. 4 is a side view of the full heel base layer of FIG. 3 showing, by way of example, an arch support.

One side of the arch support forms the inner edge of the base layer, while the other side is affixed to the arch segment. FIG. 4 is an inner side view of the base layer 40 of FIG. 3 showing, by way of example, an outer edge of an arch support 54. The arch support forms a raised contoured surface on an inner side of the base layer that corresponds with the arch of a user's foot. The space below the raised arch support can be filled or unfilled. When filled, a bottom surface of the arch support 54 is substantially aligned with the bottom surface 55 of the base layer 40. Alternating grooves can be formed within the filled side of the arch support to form multiple ridges 52 along the bottom surface. The alternating grooves allow the base layer to conform to different internal contours of the shoe, which offers a better fit, and provide additional cushioning for the user. A height of the arch support 40 can be dependent on the shape of a user's arch, foot size, or ailment, as well as other factors. In one embodiment, the height of the raised arch support can be minimal to allow users to add support pads for customizing to their needs. In a further embodiment, the arch support can have a height considered to be average to all users.

The raised arch support can be made from the same material or a different material as the rest of the base layer. In one embodiment, the raised arch support can be made from a substantially hard material, such as plastic, cork, or rubber to provide support and stability to the user. Other materials are possible.

Returning to the above discussion regarding the filled base layer of FIG. 3, the arch segment 46 is attached on a distal end to the ball segment 47. The ball segment 47 can have a substantially flat surface that extends from the arch segment to a distal end of the base layer. The distal end of the base layer can correspond to the ball of a user's foot. Specifically, the ball segment can extend just prior to, midway to, or beyond the ball of the foot.

Figure 5:
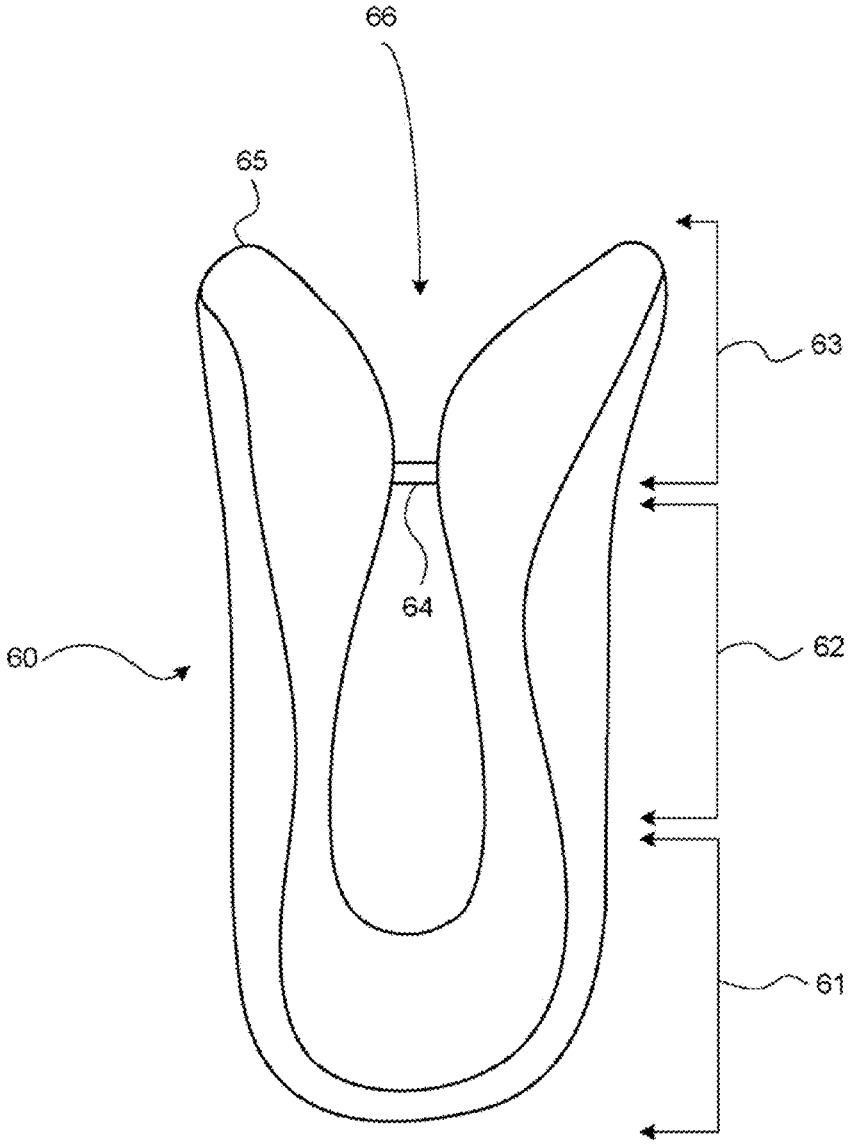
FIG. 5 is a top view of a split heel base layer for use with the customizable insole of FIG. 1.

The ball segment can have various shapes to maximize comfort and support. A further shaped base layer includes a ball segment with a cutout and sidearms to provide an adjustable width of the base layer for comfort and fit. FIG. 5 is a top view of a split base layer 60 for use with the customizable insole of FIG. 1. The split base layer 60 can be based on the filled base layer as described above with reference to FIG. 5 and can include a substantially flat surface with a heel segment 61, arch segment 62, and ball segment 63. A cutout 66 can be centrally formed within the split base layer 60, starting on a distal end of the ball segment 63 and extending through the arch segment 62 to end within the heel segment 61. A distal end of the cutout, in the ball segment, can be wide and span nearly the width of the distal end of the ball segment 63. The cutout 66 extends proximally and narrows towards the arch segment 62. A support channel can be formed at a narrow section 67 of the opening, which can be located on a proximal end of the ball segment or a distal end of the arch segment 62. As the cutout 66 extends proximally, the width of the opening expands towards the heel segment 61 and terminates in a rounded end. A size, including length and width, of the cutout 66 can be based on a user's shoe size, support required, or preference.

A distal end of the ball segment can include two sidearms 65 formed by the cutout 66, each of which are rounded on one end and affixed to the arch segment 62 on the other end. Each of the sidearms 65 includes an inner convex side that extends into the cutout 66 to form the support channel. A support band 64 can be affixed between the outer edges of the convex sides to provide additional support for a user. The band 64 can be located at the narrowest part of the opening or alternatively, directly above or below the narrowest part of the opening. If the support is undesired, the user can cut, remove, detach, or otherwise dispose of the band. In one embodiment, the band can be removably attached. In a further embodiment, the band is affixed, such that detachment is permanent. The band can be made from elastic, rubber, or plastic, as well as from other materials. A thickness of the band can be based on an amount of support needed and can differ based on shoe size or user.

Figure 6A:
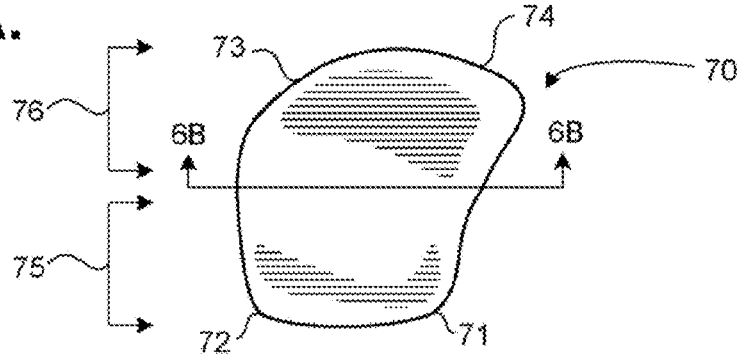
FIG. 6A is a top view of a first support pad for use with the customizable insole of FIG. 1.
Figure 6B:
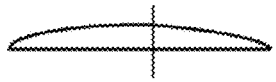
FIG. 6B provides a cross-sectional view of the first support pad of FIG. 3A.

Returning to the above discussion of the customizable insole with respect to FIG. 2, once a base layer is selected, one or more support pads 13, 14 can be positioned on a top surface of the base layer. Each support pad 13, 14 can have different shapes, sizes, and firmness. A user can position the various support pads 13, 14 on top of or adjacent to one another to obtain maximum comfort and support. FIG. 6A provides a top view of a first support pad for use with the customizable insole of FIG. 1. The first support pad 70 can have a contoured shape with one end 75 having two nearly equal rounded corners 71, 72 and the other end 76 having a rounded corner with an obtuse angle 73 and a rounded corner with an acute angle 74 that extends beyond the equally rounded corner 71 on the same side. The thickness of the first support pad 70 can vary to allow the user to select a desired thickness for maximum comfort and support. FIG. 6B provides a cross-sectional view of the first support pad 70 of FIG. 3A. A height of the first support pad 70 can represent a convex shape, such that the height is greatest in the center of the first support pad and tapers toward the outer edge. In a further embodiment, the first support pad 70 can have a uniform height.

Figure 7A:
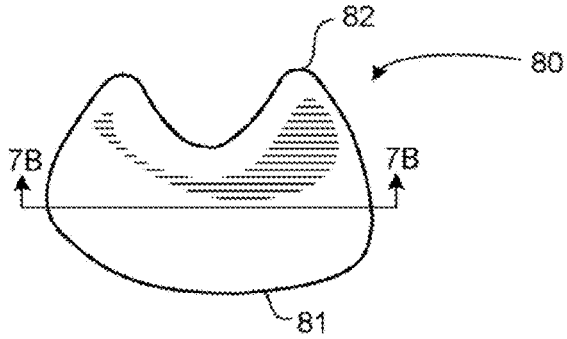
FIG. 7A is a top view of a second support pad for use with the customizable insole of FIG. 1.
Figure 7B:
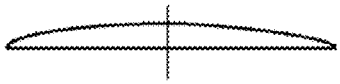
FIG. 7B provides a cross-sectional view of the second support pad of FIG. 6A.

A second support pad can be used together with or independent of the first support pad. FIG. 7A provides a top view of a second support pad 80 for use with the customizable insole of FIG. 1. The second support pad 80 can have a U-shape with a rounded end 81 and two sidearms 82 that extend from the rounded end 81. The size dimensions of the second support pad 80 can vary based on a user need, including foot size and areas of discomfort. For example, the width of the rounded end 81, at the base of the U-shape, can vary. Users with larger feet can use the second support pad having a large width, while users with smaller feet may use the second support pad having a smaller width. As well, a thickness of the second support pad 80 can vary to allow the user to select a desired thickness for maximum comfort and support. FIG. 7B provides a cross-sectional view of the second support pad of FIG. 7A. A height of the second support pad 80 can represent a convex shape, such that the height is greatest in the center of the second support pad and tapers towards an outer edge. In a further embodiment, the second support pad 80 can have a uniform height.

Figure 8A:
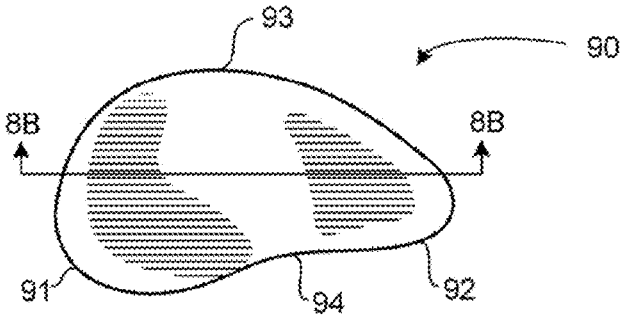
FIG. 8A is a top view of a third support pad for use with the customizable insole of FIG. 1.
Figure 8B:
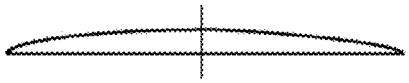
FIG. 8B provides a cross-sectional view of the first support pad of FIG. 7A.

The customized insole system can also include a third support pad. FIG. 8A is a top view of a third support pad 90 for use with the customizable insole of FIG. 1. The third support pad 90 can form a contoured shape with one side having a rounded corner 91 with an obtuse or right angle and the other end having a single rounded corner 92 with an acute angle. A rounded top 93 with an obtuse angle connects the two side ends 91, 92, while a bottom 94 includes a concave base. The size dimensions of the third support pad 90 can vary based on the user, including a user's foot size and areas of discomfort. As well, a thickness of the third support pad can vary to allow the user to select a desired thickness for maximum comfort and support. FIG. 8B provides a cross-sectional view of the third support pad of FIG. 8A. A height of the third support pad 90 can vary, such that the height is greatest in the center of the third support pad and tapers towards an outer edge. In a further embodiment, the third support pad 90 can have a uniform height.

Each of the first 70, second 80, and third support pads 90 can be made from a flexible, but firm material, including a sponge-like material, rubber, foam, gel, or cork, as well as from a combination of materials. Also, each pad can include varying levels of firmness. Other pad shapes, materials, and dimensions are possible. The pads can be covered with an attachment material, including hook and loop material or adhesive, as well as other types of attachment material. In one embodiment, one side of each pad is covered with female attachment material, while the other side is covered with male attachment material. In a further embodiment, the pads are wholly covered with one type of material.

Returning to the discussion of the customizable insole with respect to FIG. 2, one or more pads can be configured and affixed to a top surface of the base layer, which is also covered with an attachment material. The pads can be placed side-by-side, adjacent to, on top of or overlapping with other pads. Once placed, the upper layer 12 can be positioned over the support pads 13, 14 and the base layer 11.

The pads 13, 14 can be affixed to each other, the base layer, and the upper layer via the attachment material. For example, a top surface of the base layer is covered with hook material, while a bottom surface of the support pads are covered with corresponding loop material. Further, a top surface of the support pads is covered with hook material, while a bottom surface of the upper layer is covered with the corresponding loop material. The attachment material prevents the pads from slipping between the base and upper layers to provide maximum comfort, support, and stability to the user.

When placed, the upper layer 12 forms a top surface of the customizable insole upon which a user's foot rests. The upper layer 12 can be substantially flat and shaped to a whole foot and includes heel 18, arch 19, ball 20, and toe segments 21. The upper layer 12 is positioned over the base layer 11, such that the upper layer heel segment 18 corresponds to the base layer heel segment 15, the upper layer arch segment 19 corresponds with the base layer arch segment 16, and the upper layer ball segment 21 corresponds with the base layer ball segment 17. The upper layer 12 extends beyond the base layer ball segment 17 and ends at the rounded toe segment 22.

Upon placement in a shoe, the base layer 11 is positioned above a top surface of a shoe outsole or midsole, while the upper layer 12 provides a top surface for the insole system on which a user's foot is placed.

The upper layer 12 can be pre-manufactured using a flexible material based on shoe size and foot width, or customized to each individual user. The flexible material can include foam, gel, rubber, or cork, as well as other materials. Further, a top surface of the upper layer can be covered with a material, including mesh or felt to absorb foot moisture and odor. In one embodiment, air holes can be formed within the upper layer to provide cooling vents for the foot.

Figure 9:
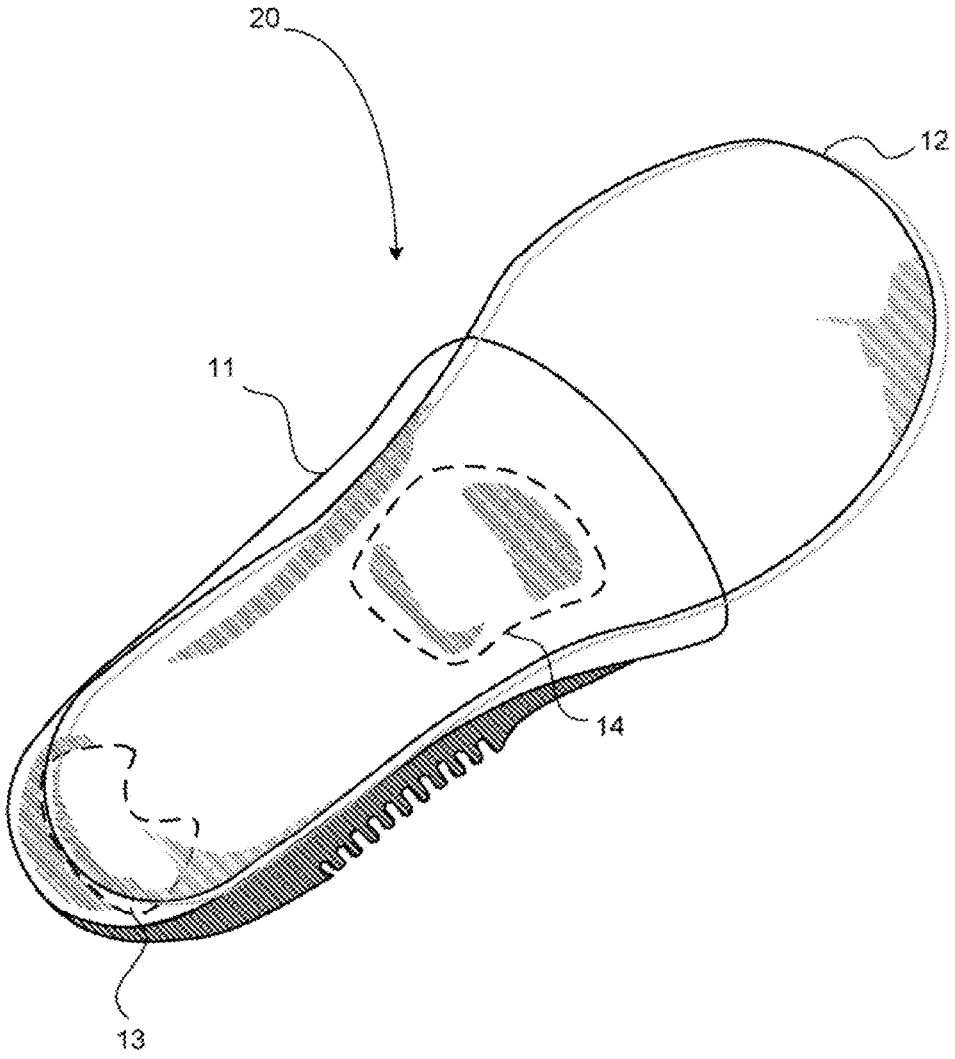
FIG. 9 is a perspective view of the customizable insole of FIG. 2.

After the customized insole has been assembled, a user can place the insole into a pair of shoes. The upper layer can mold to the support pads and base layer so that when a user places his foot into the shoe and over the insole, the pads and base layer provide support. FIG. 9 is a perspective see-through view of the customizable insole 20 of FIG. 2. The base layer 11 forms a bottom surface of the customizable insole, while the upper layer 12 forms a top surface. One or more pads 13, 14 are positioned on the base layer. The position of the pads 13, 14 can be determined by a user to provide maximum support and comfort. In particular, a U-shape pad 13 can be positioned on the base layer 11 in the heel segment, such that the rounded end of the U-shape pad corresponds with the rounded end of the heel segment. A further rounded pad 14 is centrally positioned on a top surface of the base layer 11 in the arch segment. Other pads and positions of the pads are possible. Subsequently, the upper layer 12 is placed over and removably affixed to the base layer 11 and the positioned pads 13, 14.

Specifically, the upper layer 12 is positioned so that the heel segment fits within the raised sidewalls of the base layer 11 and corresponds to the heel segment of the base layer. Also, the arch and ball segments of the base and upper layers correspond, while the toe segment of the upper layer extends beyond the ball segment of the base layer.

The customizable insole 20 can then be inserted into the user's shoe so the base layer 11 is positioned above the outsole or midsole of the shoe. The insole 20 can be removably affixed to the shoe using an attachment material, such as hook and loop material or adhesive material. For example, a top surface of the outsole or midsole can include hook material, while a bottom surface of the base layer is covered with corresponding latch material. Once inserted, the user can insert his foot into the shoe onto a top surface of the upper layer 12. If the user finds the fit of the shoe and customizable insole 20 to be comfortable and supporting, no further action need be taken. However, if the user experiences discomfort, the user can remove the customizable insole 20, remove the upper layer 12 from the customizable insole 20, and remove the pads 13, 14 for reconfiguration, including adding and removing pads until maximum comfort and support is found. Further, the customization allows the user to differently configure the left and right insoles, if needed.

While the invention has been particularly shown and described as referenced to the embodiments thereof, those skilled in the art will understand that the foregoing and other changes in form and detail may be made therein without departing from the spirit and scope.

What is claimed is:

1. A customizable insole, comprising:

a base layer shaped to a sole of a foot and extending from a heel of the foot to a ball of the foot at a distal end and comprising a substantially flat surface having a cutout that extends from the ball of the foot towards the heel of the foot and forms two rounded sidearms at the distal end of the base layer on each side of the cutout;

a band affixed on one end to one of the two rounded sidearms, extending across the cutout, and affixed on the other end to the other rounded sidearm, wherein the band comprises an elastic material;

one or more support pads each comprising a different contoured shape of varying height and removably affixed on a top surface of the base layer; and an upper layer comprising a substantially flat surface shaped to the sole of the foot and affixed on top of the support pads and base layer.

2. A customizable insole according to claim 1, wherein the one or more support pads comprise at least one of:

a first contoured support pad shaped on one end with two nearly equal rounded corners and on the other end a rounded corner is formed with an obtuse angle and a further rounded corner is formed with an acute angle;

a second contoured support pad comprising a U-shape with a rounded end and two sidearms that extend from the rounded end; and a third contoured support pad shaped by a rounded corner on a first and second side, wherein the two rounded corners are interconnected by a rounded top with an obtuse and a concave base.

3. A customizable insole according to claim 1, wherein a raised arch support is formed within the base layer.

4. A customizable insole according to claim 3, wherein the raised arch support comprises at least one of alternating ridge support and a filled support.

5. A customizable insole according to claim 1, wherein each of the base layer, support pads, and upper layer comprise at least one surface covered with attachment material.

6. A customizable insole according to claim 1, wherein the upper layer molds to the support pads and base layer.

7. A customizable insole according to claim 1, wherein a cutout is formed within the base layer at a heel end.

8. A method for providing a customizable insole, comprising:

providing a base layer comprising a substantially flat surface shaped to a sole of a foot and extending from a heel of the foot to a ball of the foot;

forming a cutout on a distal end of the base layer that terminates in a rounded end near the heel and forms one sidearm on the distal end of the base layer on each side of the cutout;

affixing a band, extending across the cutout, to each of the sidearms, wherein the band comprises an elastic material;

providing one or more support pads each comprising a different contoured shape of varying height, wherein at least one of the support pads is configured to be removably affixed on a top surface of the base layer; and providing an upper layer comprising a substantially flat surface shaped to the sole of the foot, wherein the upper layer is configured to be affixed on top of the support pads and base layer.

9. A method according to claim 8, further comprising:

constructing at least one of the support pads, comprising:

shaping a first contoured support pad with two nearly equal rounded corners on one end and forming a rounded corner with an obtuse angle and a further rounded corner with an acute angle on the other end;

forming a second contoured support pad comprising a U-shape with a rounded end and two sidearms that extend from the rounded end; and forming a third contoured support pad with a rounded corner on a first and second side, wherein the two rounded corners are interconnected by a rounded top with an obtuse base.

10. A method according to claim 8, wherein a raised arch support is formed within the base layer.

11. A customizable insole according to claim 10, wherein the raised arch support comprises at least one of alternating ridge support and a filled support.

12. A method according to claim 8, wherein each of the base layer, support pads, and upper layer comprise at least one surface covered with attachment material.

13. A method according to claim 8, wherein the upper layer molds to the support pads and base layer.

14. A method according to claim 8, wherein a cutout is formed within the base layer at a heel end.

* * * * *